United States Patent [19]

Smith et al.

[11] 4,160,304

[45] Jul. 10, 1979

[54] HOLD-OPEN ACCESSORY FOR A DOOR CLOSER

[75] Inventors: Gordon S. Smith, Dover; Theodore R. Comstock, Durham, both of N.H.

[73] Assignee: IMC Magnetics Corp., Westbury, N.Y.

[21] Appl. No.: 868,254

[22] Filed: Jan. 10, 1978

[51] Int. Cl.[2] ..... E05F 3/16

[52] U.S. Cl. ..... 16/49; 16/62; 16/64

[58] Field of Search ..... 16/49, 50, 52, 58, 62, 16/64, 69, 79, 82

[56] References Cited

U.S. PATENT DOCUMENTS

| | | | |
|---|---|---|---|
| 2,203,197 | 6/1940 | Henry | 16/50 |
| 2,731,661 | 1/1956 | Wagner | 16/65 |
| 2,861,291 | 11/1958 | Milton | 16/65 |
| 3,028,619 | 4/1962 | Schlage et al. | 16/49 |
| 3,051,982 | 9/1962 | Lasier | 16/49 |
| 3,095,599 | 7/1963 | Lasier | 16/49 |
| 3,212,122 | 10/1965 | Flint | 16/49 |
| 3,426,382 | 2/1969 | Lasier et al. | 16/49 |
| 3,496,594 | 2/1970 | Arthur | 16/49 |

*Primary Examiner*—Werner H. Schroeder
*Assistant Examiner*—Moshe I. Cohen
*Attorney, Agent, or Firm*—Alan H. Levine

[57] ABSTRACT

An accessory for use with a conventional door closer having a body for mounting on a hinged door or the door jamb and a spring biased rotatable shaft constantly urging the door toward a closed position. The accessory comprises a first member having a reaction plate fixed with respect to the door closer body, a second member, such as an externally splined ring, fixed with respect to the door closer shaft, and a member, such as a flanged collar, rotatably interconnecting the first and second members. The collar is threaded into a hole in the reaction plate, and has an internally splined hole accommodating and meshing with the splined ring. The force of frictional engagement between the flange and the reaction plate progressively increases as the door is opened, and at an adjustable predetermined open position of the door the frictional resistance between the flange and reaction plate is stronger than the closing force of the door closer, so that the door is held open.

7 Claims, 7 Drawing Figures

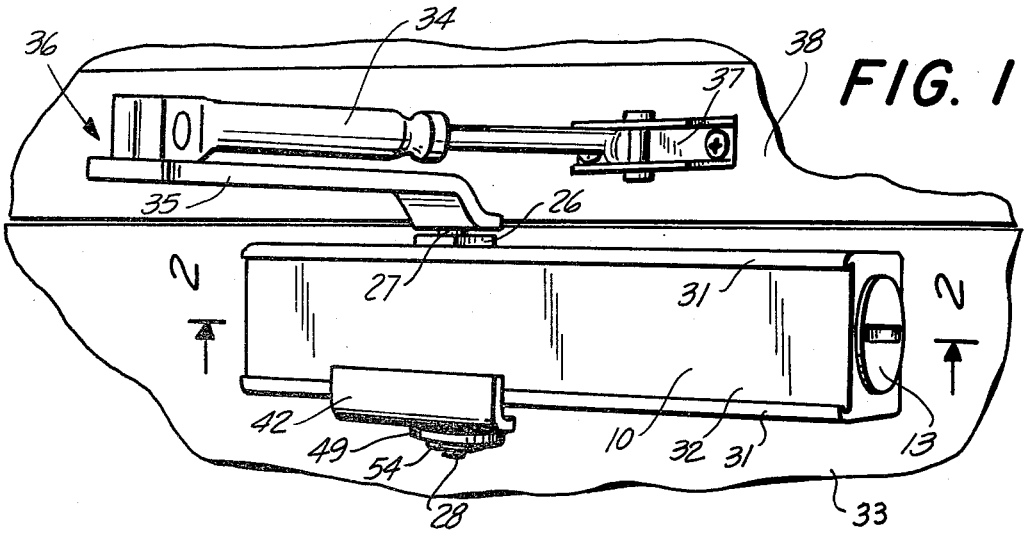
FIG. 1
FIG. 2
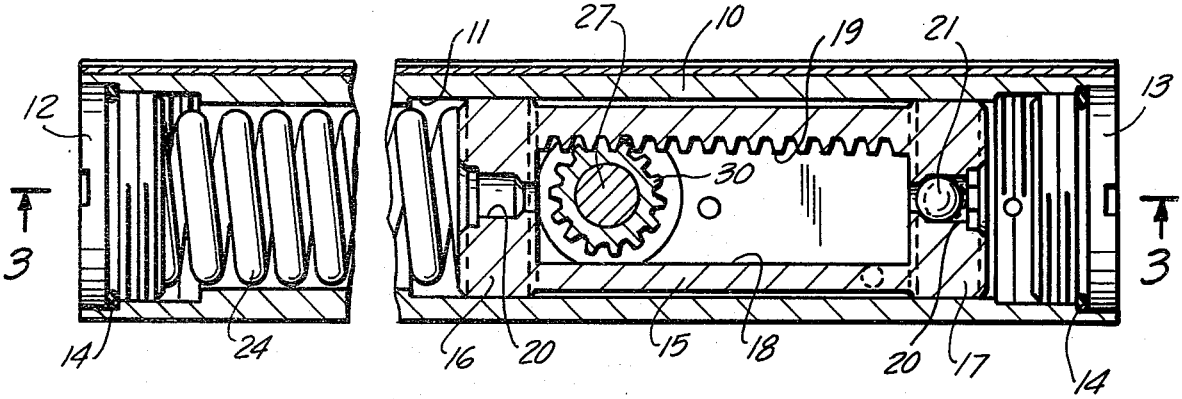
FIG. 3
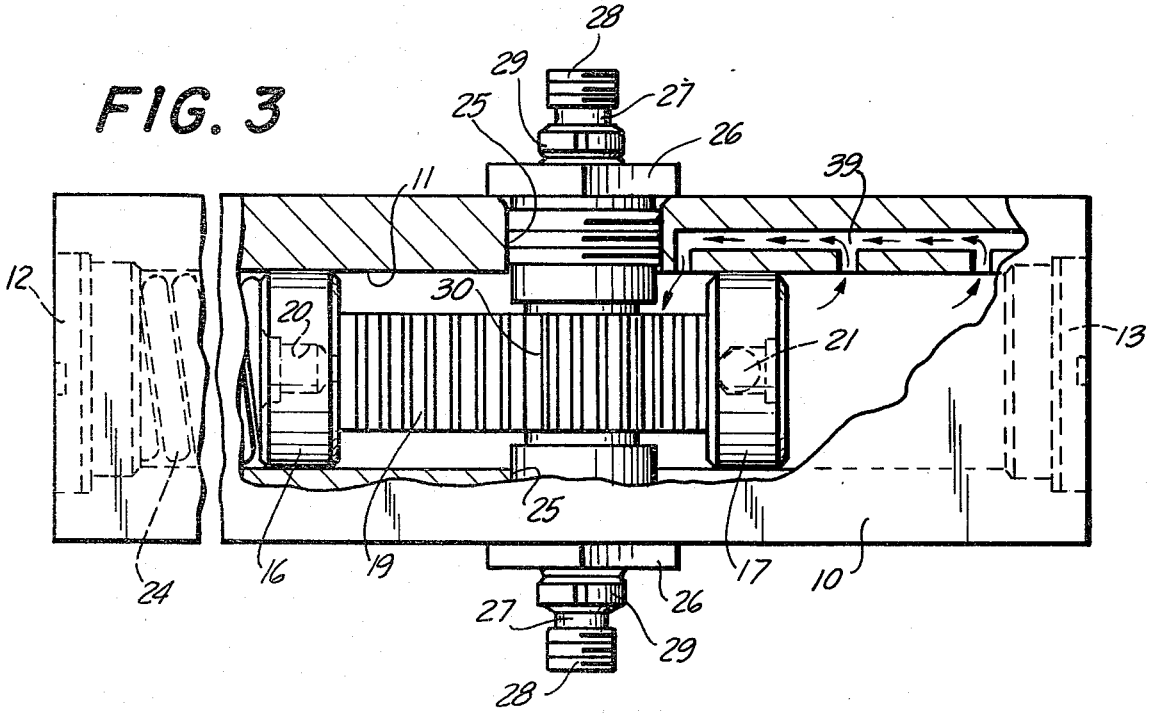

HOLD-OPEN ACCESSORY FOR A DOOR CLOSER

This invention relates to door closers of the type which are mounted between a hinged door and the door jamb and which close the door at a controlled rate after the door has been opened and released. More particularly, the invention relates to an accessory for use with such a door closer which can hold the door open against the closing force of the door closer.

The hold-open accessory of this invention is applicable to the type of conventional door closer including an elongated body containing a slidable piston. The piston is urged in one direction by a spring, the speed of movement of the piston under the influence of the spring being controlled by the dashpot effect of a fluid within the body. A shaft extends from within the body to a point outside the body, the shaft being rotated by movement of the piston under the influence of the spring. The shaft is coupled to a linkage so that its rotation, as described above, causes an opened door to close. Opening movement of the door causes shaft rotation in the opposite direction which is transmitted to the piston and moves the latter in a direction to compress the spring. Upon release of the door, the compressed spring once again moves the piston in a direction to cause the shaft to rotate so as to close the door.

Arrangements are known for use with door closers to hold the door open, against the closing force of the door closer. However, known arrangements have one or another disadvantage. For example, some existing hold-open devices must be manually manipulated each time the door is to be held open. Other hold-open devices are capable of holding the door open only at a single angle, and offer no possibility of adjusting the angle at which the door is held open.

It is an object of the present invention to provide a hold-open accessory for a door closer which is effective to hold a door open, without any manual manipulation of the accessory, simply by swinging the door to the desired position in which it is to be held open.

It is another object of the invention to provide a hold-open accessory which can be adjusted in advance to hold the door open at any desired angle within a broad range of angular positions of the door.

It is a further object of the invention to provide such a hold-open accessory which can be applied to an existing door closer without alteration of the latter, and if the door closer is already mounted in position the accessory can be applied to it without disturbing its mounting.

It is an additional object of the invention to provide such a hold-open accessory employing two opposed friction surfaces which are drawn toward each other by a screw thread connection as the door is opened, the frictional force between the two surfaces thereby progressively increasing until it is large enough to overcome the closing force provided by the door closer.

Additional objects and features of the invention will be apparent from the following description in which reference is made to the accompanying drawings.

In the drawings

FIG. 1 is a perspective view of a conventional door closer, mounted between a door and jamb, to which a hold-open accessory according to the present invention has been applied;

FIG. 2 is a fragmentary longitudinal cross-sectional view, on an enlarged scale, taken along line 2—2 of FIG. 1;

FIG. 3 is a longitudinal cross-sectional view taken along line 3—3 of FIG. 2, the hold-open accessory not being shown in this figure;

Figure 4:
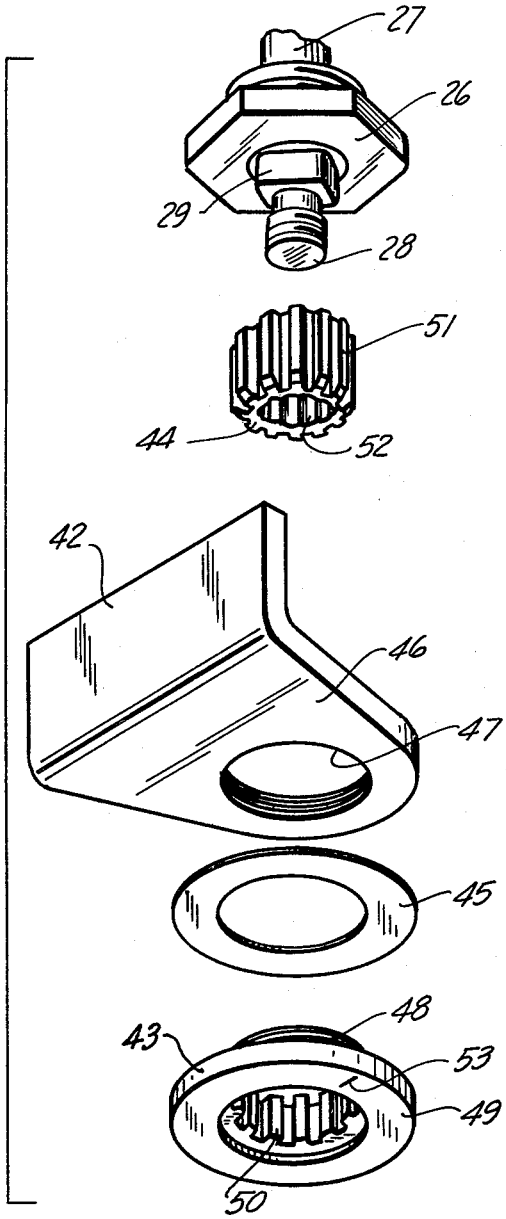
FIG. 4 is an exploded perspective view of the hold-open accessory and a part of the door closer shaft with which it cooperates.

A door closer of the type with which the present invention is useful, and illustrated in FIGS. 1-3, includes an elongated housing 10 having a longitudinal generally cylindrical bore 11. Each end of bore 11 is internally threaded and is closed by an externally threaded end cap 12 and 13 accommodated therein. An O-ring 14 provides a fluid-tight seal between each end cap 12 and 13 and body 10 so that liquid which fills bore 11 does not seep out past the end caps.

Slidable longitudinally within bore 11 is a piston 15 having a head 16 at one end and a head 17 at the other end. Heads 16 and 17 have circular cross-sectional shapes and fit snugly but slidably within bore 11. Between heads 16 and 17, piston 15 is formed with a through slot 18 one longitudinal side of which defines a toothed rack 19. Each head 16 and 17 has a stepped hole 20, through which slot 18 communicates with bore 11, the hole in head 17 containing a ball valve member 21.

A compression coil spring 24 within bore 11 is seated at one end against end cap 12 and at the other end against piston head 16. Spring 24 constantly urges piston 15 toward the right in FIGS. 2 and 3, i.e., toward end cap 13.

Two opposite sides of housing 10 are provided with aligned, internally threaded holes 25. An externally threaded bushing 26 is threadably accommodated within each hole 25 in a fluid tight manner. Rotatably supported within bushings 26 is a short shaft 27 extending across the entire housing 10, both ends of shaft 27 projecting beyond the housing and terminating in threaded ends 28. Inwardly of each threaded end 28, shaft 27 is formed with a noncircular, in this example square, portion 29, each square portion being exposed outside housing 10. The central portion of shaft 27, inside housing 10, defines a pinion 30 within slot 18 in piston 15. Pinion 30 meshes with a rack 19, so that rotation of shaft 27 causes longitudinal movement of piston 15 within housing 10, and vice versa.

As shown in FIG. 1, the door closer is typically mounted by fixing body 10 to a door 33 near the upper edge of the door. Body 10 is attached to the side of the door which faces in the direction in which the door moves when being opened. One face of body 10 may be formed along its longitudinal edges with inturned lips 31 for slidably accommodating a decorative plate 32 which may bear a trademark. The door closer also includes a linkage comprising an adjustable length rod 34 and a flat bar 35 pivotally joined at 36. The end of rod 34 opposite the pivot connection 36 is pivotally connected to a bracket 37 fixed to the top of the door jamb 38. The end of bar 35 opposite pivot connection 36 has an S-shaped bend and is formed with a non-circular hole (not shown) which non-rotatably accommodates one of the square portions 29 of shaft 27. A nut (not shown) is secured on the threaded end 28 of shaft 27 nearest bar 35 to prevent the bar from slipping upwardly off the square portion of the shaft. If desired, housing 10 could be mounted on jamb 38 and bracket 37 fixed to door 33.

When door 33 is closed, piston 15 is in the location shown in FIG. 2. As the door is opened, linkage 34, 35 pivots and the non-rotatable connection between bar 34 and shaft 27 causes the shaft to rotate in a counterclockwise direction in FIG. 2. As a result of the engagement between pinion 30 and rack 19, piston 15 is moved toward the left, as indicated in FIG. 3, compressing spring 24. During this movement, liquid within the portion of bore 11 occupied by spring 24 flows through hole 20 in piston head 16 into the region between the piston heads, and liquid between the piston heads flows through hole 20 in piston head 17 into the portion of bore 11 between head 17 and end cap 13. This latter flow is permitted because ball valve 21 moves to the broken line position in FIG. 2.

When the opened door is released, spring 24 pushes piston 15 back toward end cap 13, and as a result of the engagement between rack 19 and pinion 30, shaft 27 is rotated in a clockwise direction in FIG. 2. The shaft causes pivotal movement of linkage 34, 35 in a direction which causes door 33 to close. The speed with which the door closes is limited by the dashpot effect of the liquid between piston head 17 and end cap 13. This liquid cannot flow through hole 20 in head 17 because ball valve 21 is in its solid line position in FIG. 2 and the position shown in FIG. 3, closing hole 20. Instead, the liquid is forced through a constricted passageway 39 in housing 10, as indicated by the arrows in FIG. 3. This liquid finds its way to the region between piston heads 16 and 17, and then through hole 20 in head 16 to the portion of bore 11 accommodating spring 24. In practice, the cross-sectional size of passageway 39 is variable to adjust the speed at which the door closes.

As thus far described, the door closer is completely conventional. The present invention relates to an accessory applicable to the door closer to make the latter ineffective to close a door which has been opened to a preselected angular position.

Figure 5:
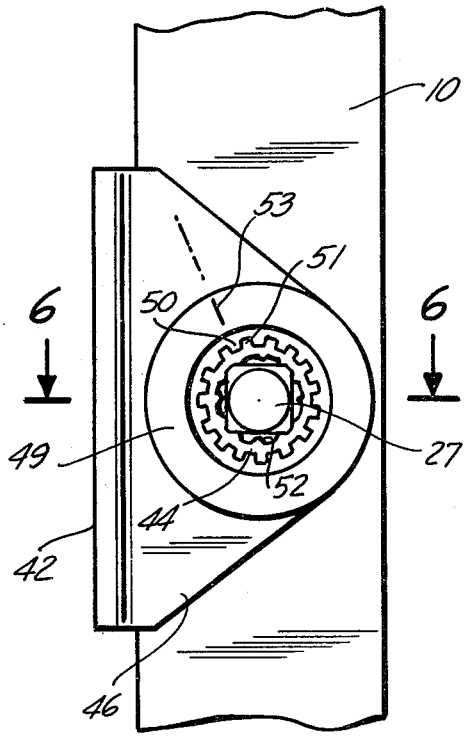
FIG. 5 is a fragmentary elevational view of the assembled door closer and hold-open accessory.

The hold-open accessory comprises (see FIGS. 4–7) an angle member 42, a clutch element 43, a splined ring 44, and a washer 45. One arm of angle member 42 serves as a reaction plate 46 against which clutch element 43 reacts. Reaction plate 46 has an internally threaded hole 47; when angle member 42 is fitted over one of the long corners of housing 10, as shown in FIGS. 1 and 5, the angle member is located so that hole 47 surrounds square portion 29 of shaft 27. The shorter arm of angle member 42 fits against one of the lips 31 (see FIGS. 6 and 7) so as to prevent relative rotation between angle member 42 and body 10.

Clutch element 43 comprises a collar 48 having at one end a flange 49 projecting radially outwardly. The collar is externally threaded, is threaded into hole 47 in reaction plate 46, and is formed with internal splines 50. The outer face of flange 49 carries a permanent witness mark 53, which may be painted on but preferably is etched into the surface of the plate. Washer 45 fits around collar 48 and is located between flange 49 and reaction plate 46. The washer is preferably formed of thin sheet metal, such as brass. Splined ring 44 has external splines 51 and fits snugly within collar 48 with splines 51 and 50 in meshing relationship. The opening 52 in ring 44 has a non-circular shape (see FIGS. 4 and 5) and fits snugly and non-rotatably on one of the square portions 29 of shaft 27. Opening 52 preferably has an undulating shape, as shown, so that it can be fitted over portion 29 in a variety of angular orientations.

Figure 6:
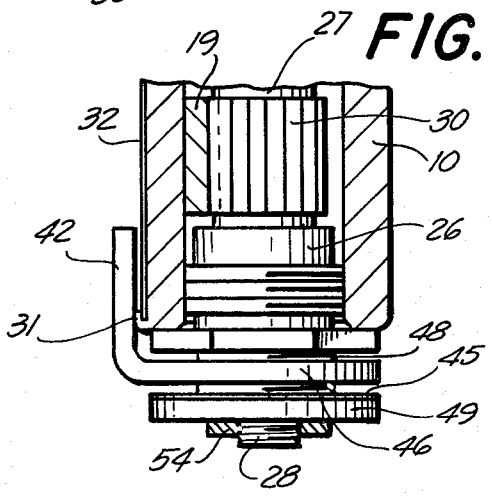
FIG. 6 is a cross-sectional view taken on line 6—6 of FIG. 5 showing the relationship of the parts when the door is closed.

In use, the parts 42–45 of the hold-open accessory are assembled, and clutch element 43 is screwed into hole 47 until it is as tight as possible using one's fingers, i.e., washer 45 is snugly sandwiched between reaction plate 46 and flange 49. A pencil mark is made on reaction plate 46 in radial alignment with witness mark 53, the pencil mark being indicated as a broken line in FIG. 5. Clutch element 43 is then unscrewed through an angle equal to the angle at which the door is to remain open. For example, if it is desired that the door be held open at an angle 90° to the plane of the door jamb, clutch element is unscrewed a quarter turn, i.e., until the pencil mark is 90° to witness mark 53. In this condition, the hold-open accessory is applied to the door opener which is already installed as shown in FIG. 1. Specifically, angle member 42 fits around a corner of body 10, and splined ring 44 fits over the square portion 29 of shaft 27 which is not assembled with the end of bar 35. In case ring 44 does not fit on portion 29 in its existing orientation, the ring can be slipped out of collar 48 rotated to a different orientation, and reinserted. Due to the plurality of splines and the undulating shape of opening 52 in the ring, an orientation can be found in which ring 44 slides into collar 48 and also slides over square portion 29. A nut 54 is then threaded on to threaded end 28 (FIGS 1, 6 and 7) to retain the accessory in assembled condition with the door closer. After assembly, and with the door closed, the parts appear as shown in FIG. 6, with flange 49 and washer 45 spaced from reaction plate 46.

Figure 7:
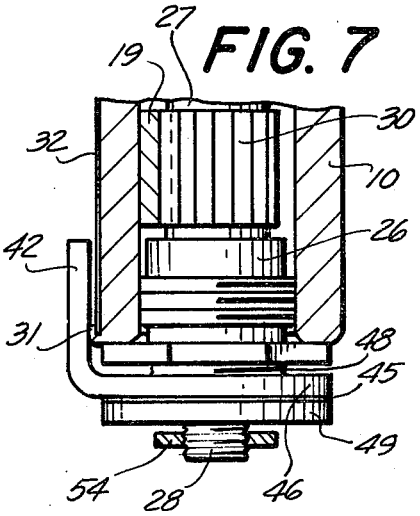
FIG. 7 is a view similar to FIG. 6 showing the relationship of the parts when the door is being held in an open position.

As the door is swung open, shaft 27 rotates with respect to body 10. Splined ring 44 and clutch element 43 are fixed with respect to and rotate with shaft 27. Angle member 42 and its reaction plate are fixed with respect to body 10. The relative rotation between clutch element 43 and reaction plate 46 causes the clutch element to be screwed further into hole 47 so as to bring flange 49 closer to reaction plate 46. As opening movement of the door continues, washer 45 becomes squeezed progressively tighter between the flange and reaction plate, thereby progressively increasing the frictional resistance to rotation between clutch element 43 and reaction plate 46. When the door reaches the 90° position, the accessory appears as shown in FIG. 7, and the frictional force on the washer will exceed the closing force applied to the door by spring 24, and hence the door remains open. The door will stay open until manually pushed toward a closed position a sufficient amount to cause flange 49 to move away from reaction plate 46 to relieve the frictional resistance to rotation and allow spring 24 to close the door. Although use of washer 45 is preferred, it could be eliminated and flange 49 allowed to frictionally engage reaction plate 46 directly.

If for some reason the door does not hold open at the desired angle, the door is closed and spline ring 44 is removed without rotating clutch element 43. The spline ring is rotated an amount equal to the angle subtended by one spline, and reinserted into the clutch element. This procedure may be continued until the door remains open at the desired angle.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. A hold-open accessory for use with a door closer which applies a closing force to a door whenever it is open, the door closer having a body intended to be mounted on a hinged door or the door jamb and a shaft which rotates with respect to the body when the door is moved about its hinged axis, the accessory comprising:

a first member fixed with respect to the door closer body, a second member fixed with respect to the door closer shaft, and clutch means threaded into one of said members and rotatable with the other of said members in a direction in which said clutch means progressively tightens against said one member in response to opening movement of the door, to thereby progressively increase the frictional resistance to rotation between said members as the door is opened, whereby at a predetermined open position of the door the resistance to rotation is strong enough to overcome the closing force applied to the door by the door closer and hence the door remains in the predetermined open position until manually moved toward its closed position.

2. A hold-open accessory as defined in claim 1 wherein said first member includes a reaction plate, said second member has external splines around its periphery, and said clutch means includes a clutch element threaded into said reaction plate and having an opening formed with internal splines meshing with said external splines of said second member.

3. A hold-open accessory as defined in claim 2 wherein said reaction plate has an internally threaded hole, and said clutch element has an externally threaded collar threaded into said hole, said collar being formed with said internal teeth.

4. A hold-open accessory as defined in claim 3 wherein said clutch element includes a flange extending outwardly from said collar, one face of said flange being opposed to a face of said reaction plate, and said faces being frictionally tightened against each other as said collar is threaded into said hole in said reaction plate.

5. A hold-open accessory as defined in claim 4 including a washer between said opposed faces of said reaction plate and said flange.

6. A hold-open accessory as defined in claim 4 including a visible locating mark on the face of said flange opposite the face opposed to said reaction plate.

7. A hold-open accessory as defined in claim 2 wherein said shaft carries a portion having a non-circular cross-sectional shape, and said second member includes a splined ring, the opening in said ring having a non-circular cross-sectional shape adapted to fit non-rotatably around said non-circular portion of said shaft in a plurality of different angular orientations.

* * * * *